US006010166A

United States Patent [19]

Hamilton et al.

[11] Patent Number: 6,010,166

[45] Date of Patent: Jan. 4, 2000

[54] BOLT SEAL PROTECTOR HASP

[75] Inventors: Craig Hamilton, Waterloo, Ind.; Robert F. Emmons, Kiowa, Colo.

[73] Assignee: Transguard Industries, Inc., Angola, Ind.

[21] Appl. No.: 09/138,761

[22] Filed: Aug. 24, 1998

[51] Int. Cl.[7] ..... E05B 67/38

[52] U.S. Cl. ..... 292/282; 292/DIG. 2; 70/56

[58] Field of Search ..... 292/282, 285, 292/286, DIG. 2, DIG. 54, 327; 70/54–56, 417

[56] References Cited

U.S. PATENT DOCUMENTS

| | | | |
|---|---|---|---|
| 2,855,237 | 10/1958 | Becker | 292/285 |
| 3,951,443 | 4/1976 | Barnaby | 292/327 |
| 4,033,155 | 7/1977 | DeLucia . | |
| 4,068,505 | 1/1978 | Volk | 70/56 |
| 4,898,008 | 2/1990 | Eberly | 70/56 |
| 4,972,689 | 11/1990 | Anderson | 70/56 |
| 5,118,149 | 6/1992 | Emmons | 292/327 |
| 5,146,771 | 9/1992 | Loughlin . | |
| 5,347,689 | 9/1994 | Georgopoulos et al. . | |
| 5,413,393 | 5/1995 | Georgopoulos et al. . | |
| 5,477,710 | 12/1995 | Stefanutti . | |
| 5,737,946 | 4/1998 | Sole | 70/54 |
| 5,743,118 | 4/1998 | Anderson | 70/56 |

*Primary Examiner*—Flemming Saether
*Assistant Examiner*—Gary Estremsky
*Attorney, Agent, or Firm*—John G. Gilfillan, III; William Squire

[57] ABSTRACT

A lower steel plate casing has a housing attached to a back plate secured to a door and defines an enclosed chamber defining a channel portion through which a portion of an operating handle of a swing door keeper bar passes. An upper steel plate casing has a housing and is pivoted to the back plate. The upper casing housing defines a further enclosed chamber having a further channel portion through which a portion of the handle passes in cooperation with the lower casing channel portion in a housing locking position. A bolt seal has a head fixed to a shank and a lock body releaseably attached to the shank for locking the two housings together. The shank is laterally protected by the enclosed chambers and axially protected by the head at one shank end and the lock body at the other shank end and by various housing plates having apertures in which the head, lock body and the bolt shank are received.

18 Claims, 4 Drawing Sheets

FIG. 2
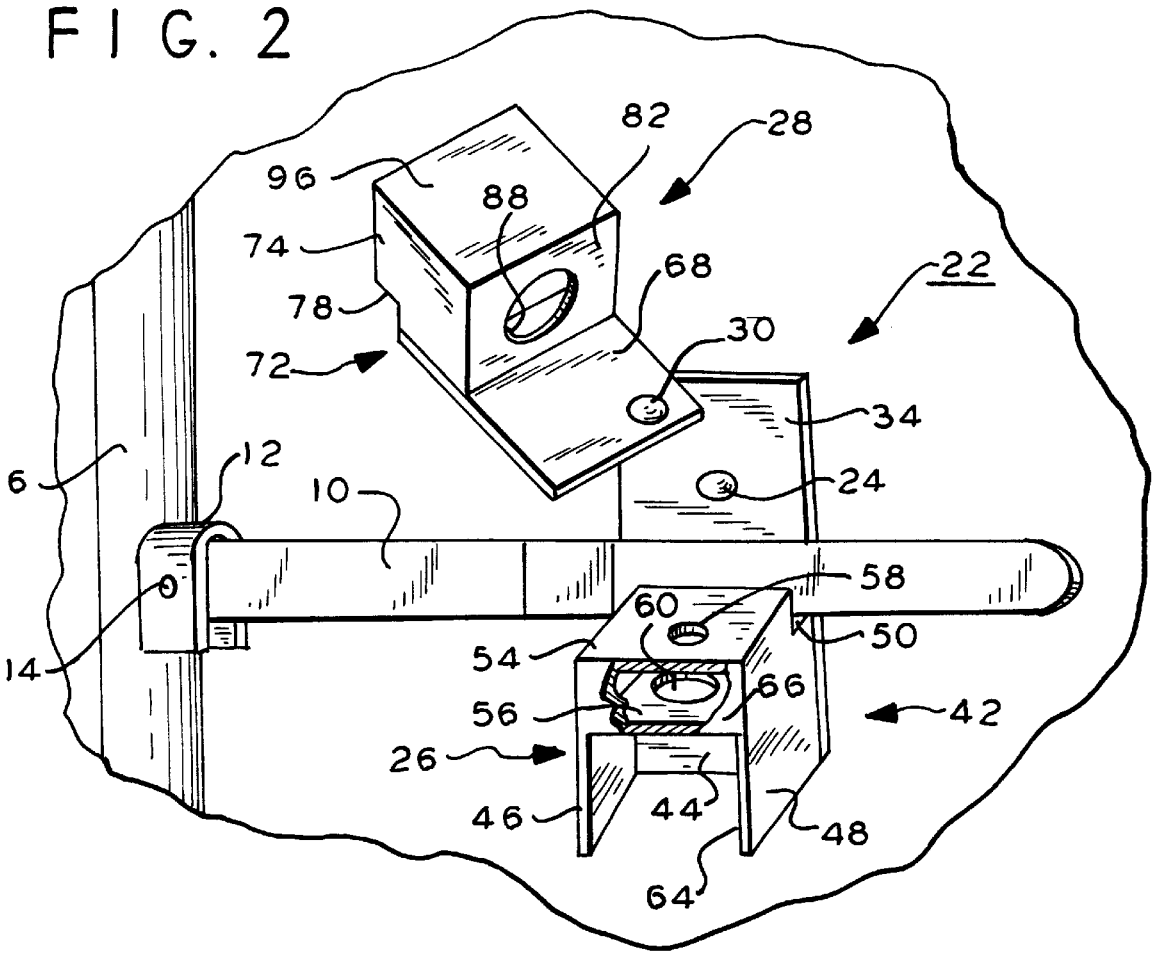
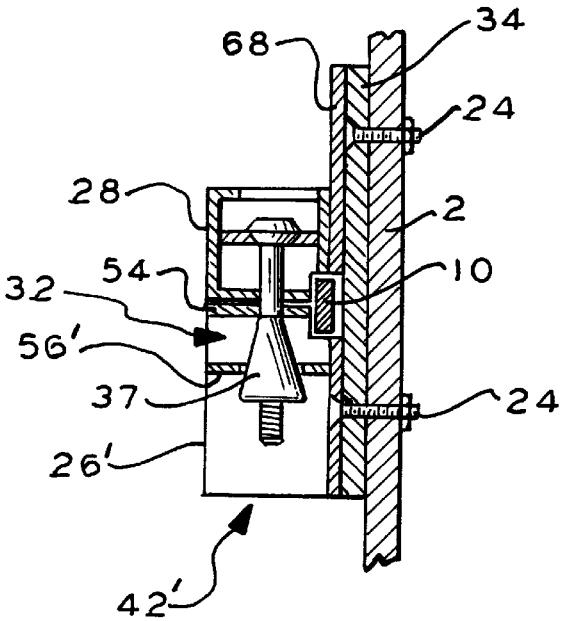
FIG. 11

BOLT SEAL PROTECTOR HASP

This invention relates to bolt seal protector hasps for bolt seals having a shank, a head secured to a shank end and a lock body selectively attached to the shank distal the head for securing the hasp, and more particularly, to a seal protector hasp for use with keeper bar handles on swinging cargo doors to provide tamper resistance for the seal.

Of interest are commonly owned U.S. Pat. No. 5,749,610 in the name of Brammall et al. and U.S. Pat. No. 5,732,989 in the name of Stevenson et al. and commonly owned copending patent application Ser. No. 909,247, now U.S. Pat. No. 5,878,604 entitled Protection Device for Bolt Seal and Hasp filed Aug. 11, 1997 in the name of Stone et al., all incorporated by reference herein.

U.S. Pat. No. 5,732,989 ('989) discloses a reusable bolt seal which advantageously is preferably used with the seal protector hasp of the present invention.

U.S. Pat. No. 5,878,604 ('247) discloses seal protectors for use with bolt seals having a head, a shank and a lock body containing a locking mechanism for locking to the shank. The seal protectors are disclosed for use with rail car latches and preferably use the reusable bolt seal of the '989 patent.

A cargo container hasp protector is disclosed in U.S. Pat. No. 5,118,149 ('149). This hasp protector is for use with a handle attached to a keeper bar typically used with swinging doors on trucks or containers. The disclosed hasp protector protects the conventional hasp that accompanies the truck or container handle-keeper bar arrangement. The protector overlies the conventional hasp to protect that hasp while utilizing a bolt seal for locking the hasp. The present inventors recognize that the conventional hasp as supplied with such arrangements may be easily defeated by tampering. The hasp and bolt seal shank, for example, in the '149 arrangement are each accessible through openings in the protector. Such openings permit an authorized user to cut the bolt shank with a conventional bolt cutter. However, as disclosed in U.S. Pat. No. 5,878,604, such openings are not desirable to obtain optimum bolt protection.

Seal protectors disclosed in U.S. Pat. No. 5,878,604 employ the reusable bolt seals which cooperate with the protectors to preclude access to the bolt shank by bolt cutters and other tampering tools to provide enhanced tamper resistance.

U.S. Pat. No. 4,898,008 discloses a padlock protector for use with handles or lock arms employed with keeper bars on swing out truck doors. The protector includes a block pivotally connected to one of a lock arm catch and closure member. The block includes peripheral flanges and a recessed body to partially surround the padlock shackle and housing to prevent opening of the padlock by cutting or prying the shackle and separating it from the housing. However, the peripheral flanges comprise two parallel plates with the padlock shackle exposed therebetween. Tamperers have access to the shackle with cutting or other tampering tools. Such access is believed not desirable by the present inventors.

The present inventors recognize a need for a replacement seal protector hasp with respect to the type disclosed in the '149 patent for use with keeper bar handles or arms on swing out doors such as used on trucks or cargo containers. They recognize a need for providing a seal protector hasp for protecting the bolt seals of the type disclosed in the '149 patent and in the aforementioned commonly owned copending application and patents, and particularly for use with a reusable bolt seal of the '989 patent in conjunction with such handles and arms.

A bolt seal protector and hasp according to the present invention is for use with a swing out door keeper bar and operating handle, the seal comprising a shank, a head secured to the shank and a lock body for locking engagement with the shank, the hasp comprising a first casing for fixed attachment to the door and for receiving a first portion of the shank adjacent to one of the head and lock body. A second casing is for pivotal attachment to the door and has a first pivot position in a handle lock state adjacent to the first housing for receiving a second portion of the shank adjacent to the other of the head and lock body, and a second pivot position spaced from the first housing in a handle release state, the casings including channel means for receiving and securing the handle in the first position, the casings include means cooperating with the head and lock body for enclosing the bolt shank in the handle lock state to preclude access to the shank by tampering tools.

In one aspect, the first casing comprises a first plate having a pivot axis at the pivot attachment to the door and a first housing including a bolt shank receiving member secured to the first plate spaced from the pivot axis.

In a further aspect, the second casing comprises a second plate and a second housing secured to the second plate, the first plate being pivotally secured to the second plate at the pivot axis.

Each of the casings may have a channel which mate when the casings are engaged to form the channel means.

The first casing may comprise a first plate and a first housing secured to the first plate, the first housing comprising top and bottom walls and an intermediate wall parallel to the top and bottom walls, the top wall having a head receiving aperture for passing the head therethrough, the bottom wall and the intermediate wall each having an aperture for receiving the shank, the housing including side and front walls for forming and enclosing corresponding chambers therebetween in cooperation with the top, intermediate and bottom walls.

The second casing member may include a second plate and a second housing secured to the second plate, the first plate being pivotally attached to the second plate.

In a further aspect, the second housing comprises a second top plate, a second bottom plate, further side walls and a further front wall forming a further chamber that is enclosed by the further walls, the second top plate having the second shank receiving aperture and the second bottom plate having a lock body receiving aperture for receiving a portion of the lock body.

In a still further aspect, the side walls of the first and second housings each have a notch which cooperate with each other and with the first and second plates to form the channel means.

BRIEF DESCRIPTION OF THE DRAWING

FIG. 2 is a view similar to that of FIG. 1 wherein the hasp is in the unlocked state;

FIG. 11 is a side elevation sectional view similar to the view of FIG. 5 of a second embodiment of a protector and hasp according to the present invention.

In FIG. 1, a truck or container door 2 is secured to hinges (not shown) for rotation about a hinge axis in a known manner to open and close a cargo bay (not shown). Door 2 may be one of a pair of such doors (not shown). Attached to the door and truck or container body is a conventional door locking mechanism 4. Mechanism 4 comprises a keeper bar 6, a cylindrical rod, and a plurality of brackets 8, one being shown, for rotatably securing the bar 6 to the door. A handle 10, typical a flat metal bar, which may be bent somewhat to form a shallow U-shape, is pivotally secured to the bar 6 by yoke 12 at pin 14. The handle 10 pivots in directions 16.

Figure 1:
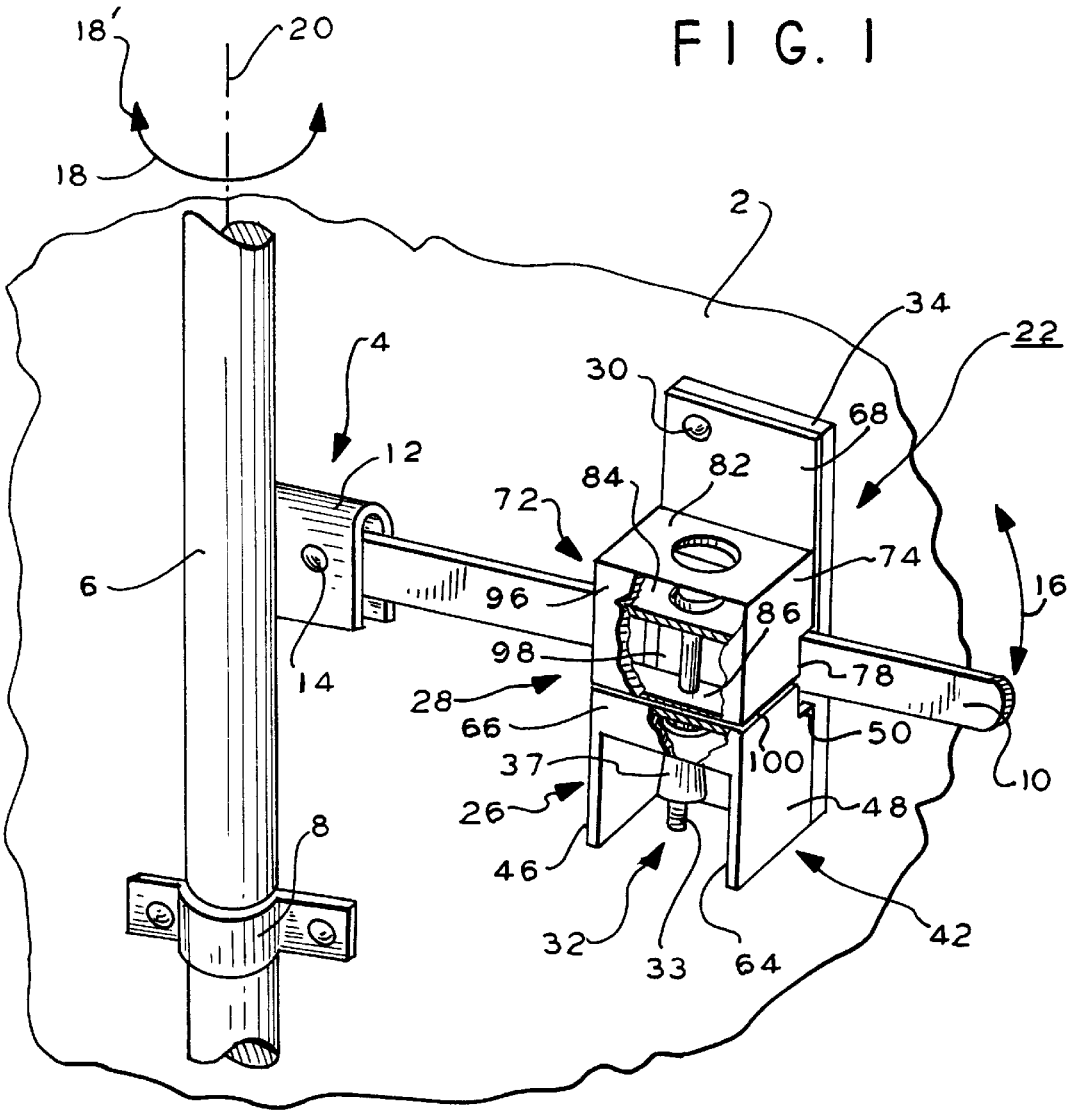
FIG. 1 is a fragmented isometric view partially in section of an embodiment of the seal protector and hasp of the present invention wherein the hasp is shown in a locked state.
Figure 3:
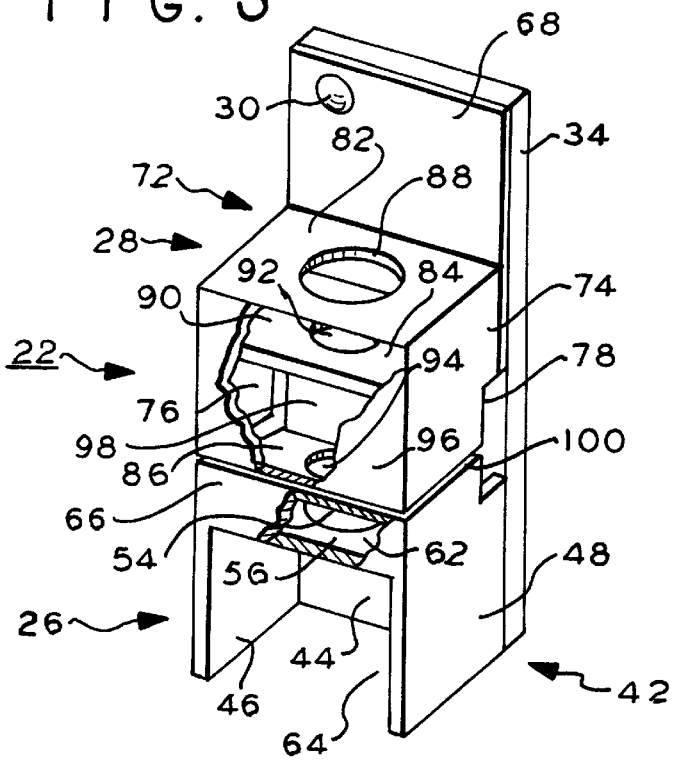
FIG. 3 is an isometric partially in section view of the hasp of the embodiment of FIG. 1 without the bolt seal.
Figure 4:
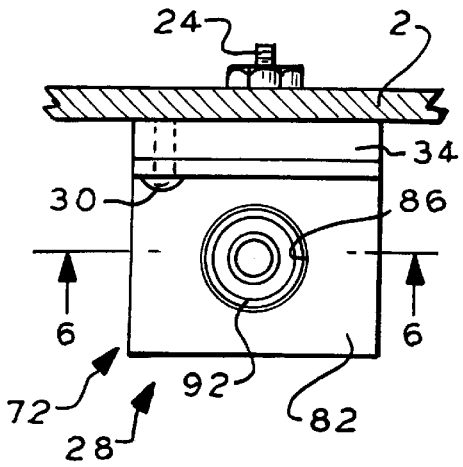
FIG. 4 is a top plan view of the hasp of the present invention.

The ends (not shown) of the keeper bar 6 terminate in a conventional locking arrangement in the truck or container body (not shown). The keeper bar 6 is rotated in directions 18 about its pivot axis 20 to lock and unlock the bar 6 from its locking arrangement. The bar 6 is locked in the position shown and is rotated in the direction of arrowhead 18' to the unlocked position 90° from the position shown. To unlock the bar 6, the operator rotates handle 10 in direction 18', rotating the bar therewith.

Locked seal protector and hasp assembly 22, secured to the door 2 by bolts 24 (FIG. 5), locks the handle 10 and thus the bar 6 in the locked position shown when bolt seal 32 is locked thereto. Bolt seal 32, FIG. 5, comprises a shank 33, a head 35 secured to one end of the shank 33 and a lock body 37 containing a locking mechanism (not shown) selectively releaseably attached to shank 33 other end by annular peripheral grooves in the shank 33. The head 35 preferably has a tapered portion 39 next adjacent to the shank 33. Seal 32 preferably is constructed as shown and described in the aforementioned patent '989 incorporated by reference in its entirety herein.

Assembly 22 comprises a fixed casing 26 that is bolted to the door 2 and a pivoting casing 28 pivoted to casing 26 by pivot element 30 which may be a rivet, a screw or other hinge forming device. Bolt seal 32 locks the casings 26 and 28 together capturing and locking the handle 10 thereto.

In the alternative, the casing 28 may be pivotally attached to the door 2 directly, if desired. It is preferred that the casing 28 be pivoted to casing 26 to provide a convenient single seal protector hasp assembly 22 to simplify attachment to the door 2.

In FIGS. 3, 6, 7 and 8, fixed casing 26 comprises a back plate 34, preferably sheet steel, having a pair of bolt 24 receiving through apertures 36 and a pivot element 30 receiving aperture 29. The bolt 24 (FIG. 5) may have a flat head 40 configuration with a tapered region that mates in a tapered counterbore 38 in the apertures 36 (FIG. 8) so the bolt head 40 is flush against the plate 34 surface. A nut secures each bolt 24, preferably hardened steel, to the door 2. In the alternative, rivets (not shown) may be used in place of the bolts 24. The bolt heads 40 are smooth surfaced to minimize tampering.

Figure 7:
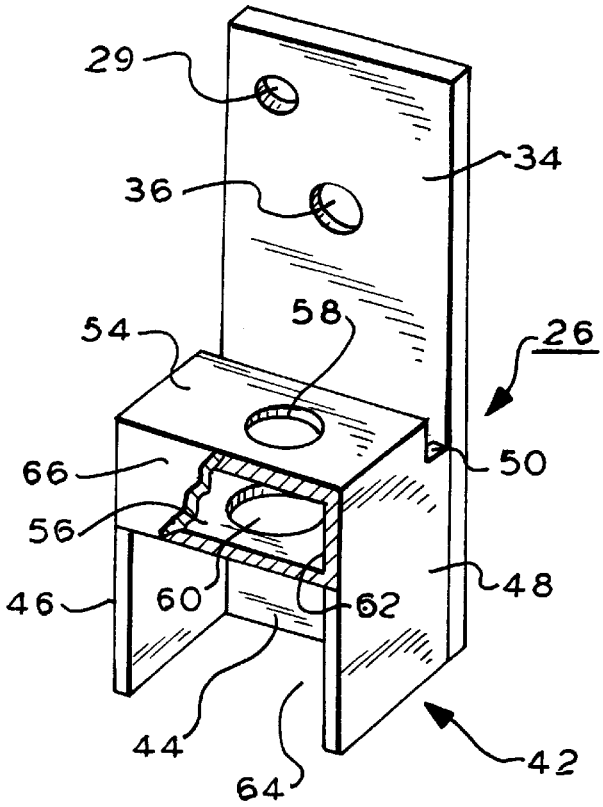
FIG. 7 is a partially in section isometric view of a fixed casing of the hasp of the embodiment of FIGS. 1 and 2 fixed to the door.
Figure 8:
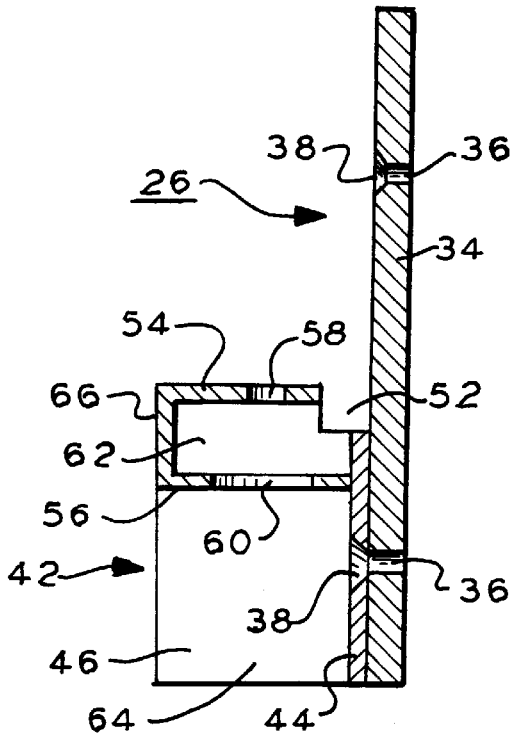
FIG. 8 is a side elevation sectional view of the casing of FIG. 7.

A housing 42, FIGS. 7 and 8, is secured by welding for example to the back plate 34. The housing 42 may be formed of welded sheet steel or cast metal. The housing 42, FIGS. 7 and 8, comprises a rear wall 44 that is flush against the back plate 34 and welded thereto. Rear wall 44 is generally rectangular. A counterbore 38 may be formed in the rear wall 44 aligned with one aperture 36 in back plate 34. Two mirror image preferably sheet steel side walls 46 and 48 are welded at their rear edges to the rear wall 44. The side walls 46, 48 are generally rectangular with aligned respective notches 50, 52 forming a handle 10 receiving channel.

A top plate 54 and spaced bottom plate 56 are welded at their respective lateral side edges to side walls 46 and 48. The top plate 54 rear edge terminates at the notches 50, 52. The bottom plate 56 is welded at its rear edge to the rear wall 44. The top plate 54 has a bolt seal shank receiving aperture 58. The bottom plate 56 has a bolt seal lock body 37 receiving aperture 60 aligned with aperture 58. The aperture 60 receives a portion of the lock body 37 to preclude access to the shank 33 by tampering tools in the region beneath the bottom plate 56.

The top plate 54 and bottom plate 56 are relatively closely spaced to form a chamber 62 therebetween with the side walls 46 and 48. The channel formed by notches 50, 52 passes through chamber 62. A bottom portion of the channel is formed by the top edge of rear wall 44, FIG. 8. The side walls 46 and 48 and rear wall 44 with plate 34 form a U-shaped barrier envelope about space 64 in which the lock body 37 is disposed, FIG. 5. This envelope protects the lock body 37 generally from tampering while permitting access to the lock body 37 to release the body 37 with a mating tool as disclosed in the aforementioned patent '989.

The chamber 62 is enclosed in the front by a preferably sheet steel front wall 66 welded to the front edges of top wall 54, bottom wall 56 and side walls 46 and 48.

Figure 9:
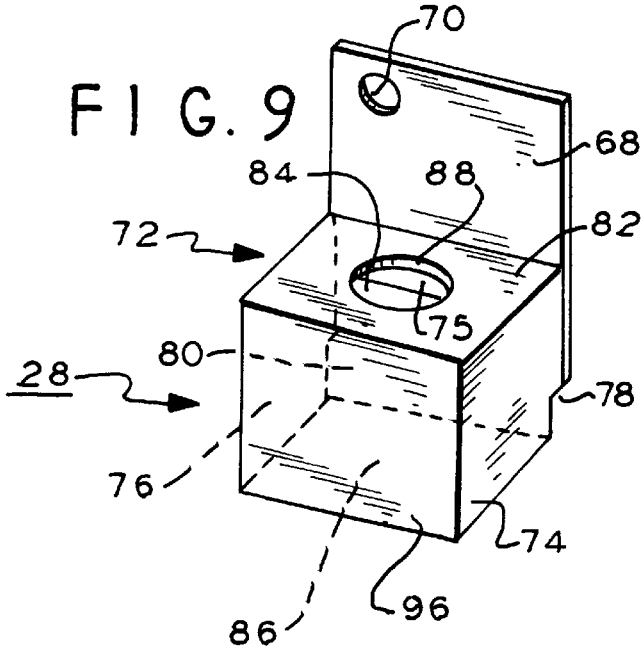
FIG. 9 is an isometric view of the pivoting casing of the hasp of the embodiment of FIGS. 1 and 2.
Figure 10:
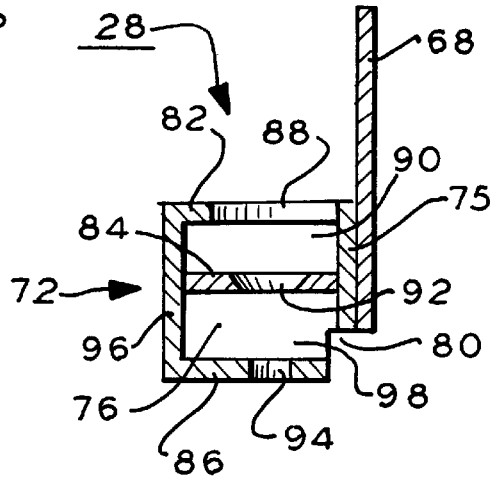
FIG. 10 is a side elevation sectional view of the casing of FIG. 9.

The pivoting casing 28, FIGS. 9 and 10, comprises a generally rectangular rear plate 68 having a pivot element 30 receiving aperture 70. The casing 28 includes a housing 72 comprising a preferably rectangular rear wall 75 welded to the plate 68. The housing 72 includes two mirror image side walls 74 and 76 welded at their rear edges to rear wall 75. Notches 78, 80 are formed in respective walls 74 and 76 forming a portion of the channel for receiving the handle 10 (FIG. 1). The notches 78 and 80 cooperate with the notches 50 and 52 in the casing 26 to form the handle 10 receiving channel.

Generally rectangular top plate 82, intermediate plate 84 and bottom plate 86 are welded at their lateral side edges to the side walls 74 and 76 in spaced relation. The bottom plate terminates at its rear edge at notches 78 and 80.

Figure 5:
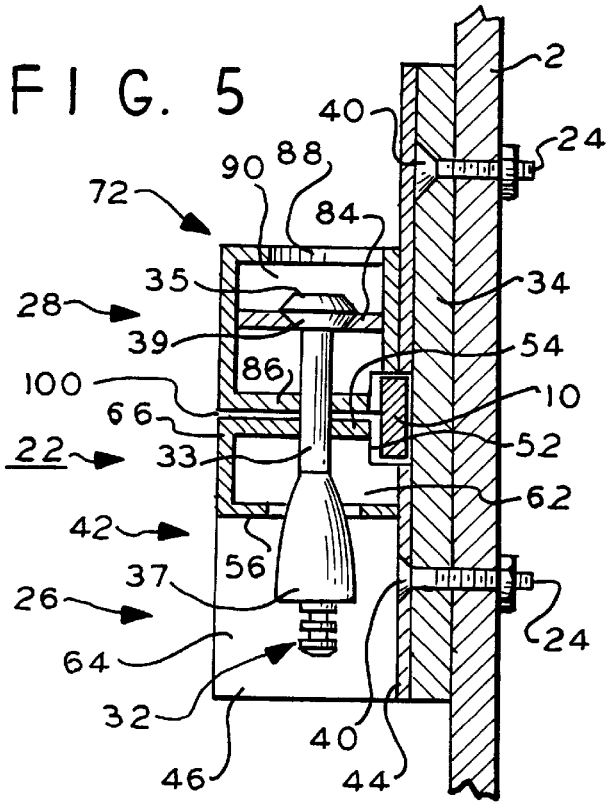
FIG. 5 is a side elevation sectional view of the hasp according to the embodiment of FIG. 1.
Figure 6:
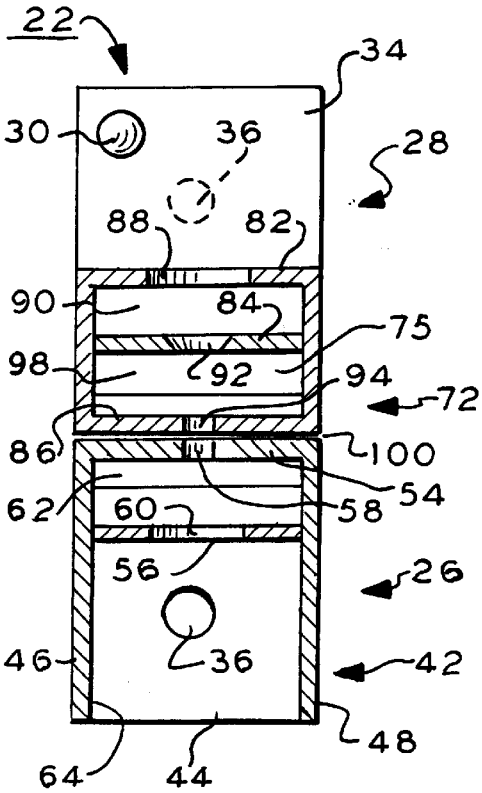
FIG. 6 is a front elevation view of the hasp of FIG. 4 taken along line 6—6.

The top plate 82 has a bolt seal head 35 receiving aperture 88. The head 35 passes through the aperture 88 into the chamber 90 between the plates 82 and 84 (FIG. 5). The intermediate plate 84 has a tapered counterbored aperture 92 for receiving the tapered portion 39 of the bolt seal head 35 (FIG. 5). The bottom plate 86 has a bolt seal shank 33 receiving aperture 94. The apertures 88, 92 and 94 are aligned for receiving the bolt seal 32. The top and intermediate plates are welded to the rear wall 75 (FIG. 10).

A front plate 96 is welded to the front edges of the side walls, top, intermediate and bottom plates to complete the housing 72. The front plate 96 encloses upper chamber 90 and lower chamber 98 in the housing front. The chamber 98 is formed by intermediate plate 84 and bottom plate 86. Chamber 98 is substantially enclosed by the rear, front and bottom plates except for the handle 10 receiving channel formed by the notches 78, 80 and the rear edge of bottom plate 86. This channel is substantially enclosed by the handle when received and the back plate 34. The top and bottom plates 84 and 86, side walls 74, 76 and rear wall 75 form a substantially enclosed chamber 98. The received handle 10 closes the channel notches and the rear of the chamber 98. Tampering tools are precluded from accessing the locked bolt seal shank 33 in the enclosed chamber 98. Preferably all of the plates forming the casings 26 and 28 are welded sheet steel or the casings formed of cast metal.

In operation, in FIG. 2, hasp assembly 22 is secured to door 2 and the handle 10 is placed in the channel formed by lower notches 50, 52 and back plate 34. The pivoting casing 28 is pivoted to the position shown to permit the handle to be so placed. With the handle in the door lock position in the notches 50 and 52, the upper casing 28 is pivoted into the position of FIGS. 1, 3 and 5. It should be understood that there is some clearance 100, FIGS. 1 and 5, between the upper pivoting casing housing 72 and the fixed casing housing 42. This clearance 100 permits the pivoting action of the housing 72 as it swings adjacent to the lower housing 42 of casing 26. This clearance 100 is relatively small and is generally too small to permit tampering access to the bolt shank 33, FIG. 1.

When the upper casing 28 is in position aligned with the lower casing 26, FIG. 1, the bolt seal 32 is then attached to lock the two casings together, securing the handle in the notches 50, 52, 78 and 80. The shank 33 portion, FIG. 5, in chamber 98 between the head 35 at plate 84 and plate 86 of the upper pivoting casing 28 is enclosed and protected from tampering tool access.

The shank 33 portion in chamber 90, FIG. 5, between the fixed casing top wall 54 and bottom wall 56 is fully enclosed and also protected from access by tampering tools. Thus the casings 26 and 28 serve to provide a substitute hasp for current hasps as employed with such latches and also protects the bolt seal from tampering tools. The lock body is snug against the fixed casing 28 housing 42 bottom wall 56 in the aperture 60 to preclude access through this aperture to the shank 33. The lock body is adjustable along the shank 33 to insure this tight relationship between the lock body and the plate 56.

In an alternative embodiment, FIG. 11, the elements with the same reference numerals are the same as in the prior embodiment. The difference is that the front wall of the lower fixed housing 26' is omitted. In this case, the bottom wall 56' is spaced from the top wall 54 sufficiently close such that the lock body 37 abuts the top plate 54 to fully protect the shank 33 from access to tampering tools through the front of the housing 42'. The lock body is steel and is difficult to open from the lateral direction through the open front.

In a further alternative embodiment, the upper pivoting casing housing may have a depending front wall (not shown) that depends in front of and overlies the lower fixed casing housing. This further protects the lower housing from tampering tools. This depending wall may be used in conjunction with and overlie an open front wall in the lower casing 26' housing, FIG. 11, or an enclosed front wall as in the lower casing 26 housing, FIG. 3.

In all of the embodiments, the top, bottom and intermediate walls are preferably parallel and the side walls are preferably parallel. The former and latter walls are all preferably normal to the back plate and rear walls. However, in other embodiments not shown the housings may be of different shapes as desired rather than rectangular polygons as shown.

There thus has been shown a keeper bar handle latch seal protector and hasp for providing enhanced bolt seal protection. The bolt seal shank is protected by an enclosed pivoting housing and a preferably enclosed fixed housing, the housings defining a channel for receiving and locking the handle thereto when locked by the bolt seal.

It will occur to one of ordinary skill that various modifications may be made to the disclosed embodiments. The disclosed embodiments are given by way of illustration and not limitation. It is intended that the scope of the invention is as defined in the appended claims.

What is claimed is:

1. A bolt seal protector and hasp for use with a swing out door, the door including a keeper bar and operating handle to be secured by a bolt seal, the bolt seal comprising a shank, a head secured to the shank and a lock body for locking engagement with the shank, the hasp comprising:

a first casing adapted for fixed attachment to the door and defining an enclosed first chamber for receiving a first portion of the shank adjacent to one of the head and lock body, the first casing being arranged so that the first chamber and received shank first portion are inaccessible to tampering tools; and a second casing defining an enclosed second chamber and including means adapted for pivotal attachment of the second casing to the door for rotation about a pivot axis, the second casing having a first pivot position in a handle lock state adjacent to the first casing for receiving a second portion of the shank adjacent to the other of the head and lock body in said second chamber, and a second pivot position spaced from the first housing in a handle release state, said casings including channel means for receiving and securing said handle in the first position, said casings cooperating with the head and lock body for enclosing the bolt shank in said chambers in the handle lock state to preclude access to the shank by tampering tools.

2. The hasp of claim 1 wherein the first casing comprises a first plate having said pivot axis and a first housing forming said first chamber and including a bolt shank receiving member secured to the first plate, the first housing being spaced from the pivot axis.

3. The hasp of claim 2 wherein the second casing comprises a second plate and a second housing forming said second chamber and secured to the second plate, the second plate being pivotally secured to the first plate at said pivot axis.

4. The hasp of claim 1 wherein each said casings have a channel which mate when the casings are engaged to form said channel means.

5. The hasp of claim 1 wherein the second casing comprises a first plate and a first housing secured to the first plate, the first housing forming the second chamber and comprising top and bottom walls and an intermediate wall parallel to the top and bottom walls, the intermediate wall for dividing the second chamber into third and fourth chambers, the top wall having a head receiving aperture for passing the head therethrough into the third chamber, the bottom wall and the intermediate wall each having an aperture for receiving the shank, said first housing including side and front walls for forming and enclosing the corresponding third and fourth chambers therebetween in cooperation with said top, intermediate and bottom walls.

6. The hasp of claim 5 wherein the first casing member includes a second plate and a second housing forming the second chamber secured to the second plate, the first plate being pivotally attached to the second plate.

7. The hasp of claim 6 wherein the second housing comprises a second top plate, a second bottom plate, further side walls and a further front wall, said first chamber being enclosed by said further walls, the second top plate having a second shank receiving aperture and the second bottom plate having a lock body receiving aperture for receiving a portion of the lock body.

8. The hasp of claim 6 wherein said side walls of said first and second housings each have a notch which cooperate with each other and with the first and second plates to form said channel means.

9. A bolt seal protector and hasp for use with a swing door keeper bar and operating handle to be secured by a bolt seal, said handle for rotating the bar between a door open state and a door locked state, said seal including a shank with a head at one shank end and a lock body secured to the shank distal the head for locking the hasp therebetween, said hasp comprising:

a first casing including means for pivotal attaching the first casing to the door, said first casing having first and second pivot positions and including at least one bolt receiving member having at least one first shank receiving aperture, said first casing including means forming a first seal receiving chamber for laterally enclosing and protecting the received shank from tampering tools; and a second casing including means adapted for for fixedly attaching the second casing to said door and including means forming a second seal receiving chamber, said first casing being aligned with said second casing in the first pivot position and misaligned in the second pivot position, said second casing having a second shank receiving aperture for alignment with the first shank receiving aperture when the casings are aligned for receiving the shank in a bolt locking state, said aligned casings including means forming a receptacle for receiving and securing said handle in said door locked state and for releasing the handle when disengaged, the first and second chambers for receiving and enclosing the seal shank between the lock body and head in the aligned state.

10. The hasp of claim 9 wherein the first casing comprises a first plate, the means for pivotal attaching the first plate at a pivot axis to the door and a first housing including said bolt receiving member secured to the plate spaced from the pivot axis.

11. The hasp of claim 10 wherein the second casing comprises a second plate and a second housing secured to the second plate, the first plate being pivotally secured to the second plate.

12. The hasp of claim 9 wherein each said casings have a channel section which mate when the casings are engaged to form said receptacle.

13. The hasp of claim 9 wherein the first casing comprises a first plate and a first housing secured to the first plate, the first housing including said at least one bolt receiving member and comprising top and bottom walls and an intermediate wall parallel to the top and bottom walls, the top wall having a head receiving aperture for passing the head therethrough, the bottom wall having a shank receiving aperture and the intermediate wall having an aperture for receiving a portion of said head and for receiving the shank, said aperture in the first housing forming said at least one bolt receiving aperture, said housing including side and front walls for forming and enclosing the first chamber in cooperation with said top, intermediate and bottom walls, said top, intermediate and bottom walls for dividing the first chamber into corresponding further chambers therebetween.

14. The hasp of claim 13 wherein the second casing member includes a second plate and a second housing secured to the second plate, the first plate being pivotally attached to the second plate.

15. The hasp of claim 13 wherein the second housing comprises a second top plate, a second bottom plate, further side walls and a further front wall forming said second chamber that is enclosed by said further walls, the second top plate having said second shank receiving aperture and bottom plate having a lock body receiving aperture for receiving a portion of the lock body.

16. A bolt seal protector and hasp for use with a swing door keeper bar operation handle and a seal for locking said handle keeper bar, said handle for rotating the bar between a door open state and a door locked state, said seal including a shank with a head at one shank end and a lock body secured to the shank distal the head for locking the hasp therebetween, said hasp comprising:

a first caging comprising a first plate member and a first housing seemed to the first plate member, the first housing including first top and bottom walls, the first top wall having a head receiving aperture for passing the head and shank therethrough, the first bottom wall having an aperture for receiving the shank, said housing including side and front walls for forming and enclosing a first chamber therebetween in cooperation with said top and bottom walls, the first chamber for receiving and enclosing a portion of the received shank for preventing access to the shank portion by tampering tools; and a second casing member including a second plate member for attachment to the door and a second housing secured to the second plate member, the first plate member being pivotally attached to the second plate member and having first and second pivot positions;

the second housing comprising a second top plate, a second bottom plate, further side walls and a further front wall forming a second chamber that is enclosed by said further walls and top and bottom plates, the second top plate having a shank receiving aperture and the second bottom plate having a lock body receiving aperture for receiving a portion of the lock body;

said first housing being aligned with said second housing in the first pivot position and misaligned in the second pivot position wherein all said apertures are aligned in the aligned position for receiving said bolt seal, said casing members including means forming a receptacle and adapted for receiving and securing said handle when engaged and for releasing the handle when disengaged, said second chamber for enclosing a further shank portion and for preventing access to the further shank portion by tampering tools.

17. The hasp of claim 16 further including an intermediate wall between said first top and bottom walls forming further chambers therebetween, the intermediate wall having an aperture for receiving the shank.

18. The hasp of claim 17 wherein the intermediate wall aperture has a tapered portion, the tapered portion for receiving a portion of the head.

* * * * *

UNITED STATES PATENT AND TRADEMARK OFFICE

CERTIFICATE OF CORRECTION

PATENT NO. : 6,010,166

DATED : January 4, 2000

INVENTOR(S) : Craig Hamilton, et al.

It is certified that error appears in the above-identified patent and that said Letters Patent is hereby corrected as shown below:

Col. 8, line 23, change "caging" to --casing--;
line 24, change "seemed" to --secured--.

Signed and Sealed this

First Day of August, 2000

*Attest:*

Q. TODD DICKINSON

*Attesting Officer*

*Director of Patents and Trademarks*